US008701687B2

(12) United States Patent
MacKinnon

(10) Patent No.: US 8,701,687 B2
(45) Date of Patent: Apr. 22, 2014

(54) PORTABLE OR FIXED VEHICLE WASHING SYSTEM

(76) Inventor: Darcy Glen MacKinnon, Calgary (CA)

( * ) Notice: Subject to any disclaimer, the term of this patent is extended or adjusted under 35 U.S.C. 154(b) by 178 days.

(21) Appl. No.: 12/964,159

(22) Filed: Dec. 9, 2010

(65) Prior Publication Data

US 2012/0145192 A1 Jun. 14, 2012

(51) Int. Cl.
*B08B 3/00* (2006.01)
*B08B 3/04* (2006.01)

(52) U.S. Cl.
USPC ..... 134/123

(58) Field of Classification Search
USPC ..... 134/123
See application file for complete search history.

(56) References Cited

U.S. PATENT DOCUMENTS 4,642,180 A * 2/1987 Kaufman ..... 209/44
5,344,570 A * 9/1994 McLachlan et al. ..... 210/709
6,358,330 B1 3/2002 McGraw
6,895,978 B2 5/2005 Midkiff
7,278,435 B2 10/2007 Roles, Jr.
2009/0266387 A1 * 10/2009 McCormick et al. ..... 134/123

* cited by examiner

*Primary Examiner* — Jason Ko
(74) *Attorney, Agent, or Firm* — Lorelei G. Graham

(57) ABSTRACT

A portable or fixed vehicle wash system that includes a collection tank having a floor and an opening. The wash system further includes a vehicle drive platform positioned above at least a portion of the opening of the collection tank. A water jet delivery system is positioned directly under the drive platform for delivering a cleansing amount of water to the vehicle. A two stage separation system that has a collection surface positioned beneath the drive platform, is in communication with the collection tank for depositing the collected water. The two stage separation system has a first large debris removal system and a second fine debris removal system. The first large debris removal system collects large debris from the collected water for removal from the collection tank, and the second fine debris removal system collects small debris suspended in the collected water after the collected water moves from the first large debris removal system to the second fine debris removal system.

12 Claims, 15 Drawing Sheets

PORTABLE OR FIXED VEHICLE WASHING SYSTEM

FIELD OF THE INVENTION

This invention relates in general to washing systems for vehicles and more particularly to a vehicle washing system that is specifically used in the oil sands and mining operations that focuses on the vehicle's undercarriage and tires.

BACKGROUND OF THE INVENTION

Typical construction sites require that soil and other debris be removed by large construction vehicles such as dump trucks and the like. Dump trucks usually have large tires that pick up mud, gravel and debris that then is tracked out of the construction sites onto municipal roads and highways. The majority of the soil and debris fall off the dump truck tires when they initially contact the municipal roads and highways. The build-up of this material on the roads presents a hazard for motorists and other commercial traffic encountering it as they drive by the construction site.

Removing this material efficiently, economically and in an environmentally safe procedure becomes a challenge for the municipalities, as street cleaning machines may remove the debris but the resulting waste run off can pollute the storm drain system and the environment.

Prior art washing systems have been devised to address some of the noted problems. For example, Midkiff is the owner of U.S. Pat. No. 6,895,978 which issued on May 24, 2005 and relates to apparatus for washing the wheels and tires of heavy duty vehicles includes a wash trough in which the wheels and tires are washed, and a refuse trough in which refuse from the vehicles is deposited for facile removal. The troughs are separated by a wall having a space through which debris from the wash trough is impelled by a stream of water into the refuse trough.

U.S. Pat. No. 6,358,330 issued on Mar. 19, 2002 to McGraw and relates to an apparatus for washing mud, dirt and silt from the tires of a truck leaving a construction site includes a water supply line, a collection basin and a grate positioned over the collection basin. The truck is driven over the grate and the water delivered to the spray ports is directed onto the tires of the truck. The mud, dirt and silt and the run-off water collects in the collection basin. Once the level of the run-off water reaches the level of the drain ports of the drainage system, the run-off water is drained from the collection basin to a recycling tank or a storm drain. Once the mud, dirt and silt reach a predetermined amount, it is removed from the collection basin.

U.S. Pat. No. 7,278,435 which issued on Oct. 9, 2007 to Roles, Jr. relates to a system and method for the collection of waste water generated in the course of maintenance or washing of a large object in an open-air, outdoor environment. The system includes a wash deck having a drain located within a valley of the deck, an interceptor drain for separation of particulates and sludge from the wash fluid, an actuator, that is responsive to changes in hydraulic pressure of wash water supply, for opening and closing a waste stream control valve and a waste steam control valve intermediate between the interceptor drain and a sanitary sewer connection. The system of this invention operates independent of elaborate controls and any external power source. Thus, it can be used in relatively remote locations and/or installed in areas where electricity is unavailable, or the presence of electrical current would be incompatible with safety of livestock or thoroughbred race horse.

The oil sands and mining environments however are a much more destructive and topographically-changing environments, than the environment found in a typical construction site. Specifically oil sands, which can also be referred to as tar sands, are a type of unconventional petroleum deposit that naturally contain a mixture of sand, clay, water, and a dense and extremely viscous form of petroleum know as bitumen. Due to the viscous nature of oil sands, heavy machinery and transport vehicles operating in the oil sands sites routinely and inevitably pick up large amounts of soil containing bitumen. There is a reduced life span for the major drive train, u-joints and other mechanical under body components of these vehicles, due to the corrosive quartz based sand trapped in the clay and the excessive build up of lime, mud, organic materials and a hydrocarbon rich bitumen mixture. This build up of material can weigh over 900 lbs per vehicle, impacting the vehicle's cooling capabilities and adding additional stress to the transmission and accessible rotating components. Typically the life expectancy of light trucks for example in the oil sands sites near Fort McMurray Alberta Canada is approximately 60,000 km.

Current wash systems in bitumen rich sites near Fort McMurray, are costly, time and energy consuming, and not environmentally friendly. The cleaning time for one vehicle is lengthy due to the nature of the bitumen, gains only marginal results and the vehicle is out of operation for long periods of time. As a result, vehicles are cleaned three to four times yearly. Bitumen can be nearly impossible to remove using standard practices. Therefore the dirty vehicles unintentionally deposit loose chunks of mud and bitumen on highways and streets creating an unsafe environment for local residents and wildlife.

Typically, washing systems have tried to remove the build up from the tires and undercarriage of vehicles by using flocculants and other chemicals. Additionally, various types of water jetting systems have been used to power wash the bitumen mixture off the vehicles. However the resulting run off an environmental challenge due to the large amount of hazardous solids present in the water.

Thus A portable or fixed and mining operation vehicle wash system which extends vehicle life, eliminates track out in local townships, is structurally stability, employs zero flocculants, can be portable and located at key points within a cite operation, targets under carriage and tires employing high volume, high pressure nozzles, requires minimal cycle time (less than two minutes per cleaning), can be a self contained unit, has automatic accumulation and solids removal for safe disposal, and can recycle heated or unheated water for continuous use would be desirable.

SUMMARY OF THE INVENTION

An object of one aspect of the present invention is to provide an improved a portable or fixed vehicle wash system and method of operation.

In accordance with one aspect of the present invention there is provided a portable or fixed vehicle wash system that includes a collection tank with a floor and an opening. The wash system further includes a vehicle drive platform positioned above at least a portion of the opening of the collection tank. A water jet delivery system is positioned directly under the drive platform for delivering a cleansing amount of water to the vehicle. A two stage separation system has a collection surface positioned beneath the drive platform, and is in communication with the collection tank for separating and depositing the collected water. The two stage separation system has both a large debris removal system and a fine debris removal system. The large debris removal system collects large debris from the collected water for removal from the collection tank, and the fine debris removal system collects small debris suspended in the collected water after the collected water moves from the large debris removal system to the fine debris removal system.

Conveniently, the collection surface is a floor pan having a downward angled slope greater than ¼ inch over 12 inches and has a series of engagement members that engage the both the large and fine debris.

Preferably, the collection tank further includes a series of chambers separated from one another by a series of weir members and a series of baffles, wherein each of the baffles has a screened opening to allow the collected water to flow between the baffles. The screened openings of the baffles are graded from course to fine to filter the fine debris progressively as the collected water moves through the collection tank.

In accordance in another embodiment of the present invention there is provided a method of washing a portable or fixed vehicle including driving the vehicle across a vehicle drive platform positioned above at least a portion of a collection tank having a floor and an opening; delivering a cleansing amount of water to the vehicle from a water jet delivery system positioned directly under the drive platform; collecting and depositing the collected water in a two stage separation system having a collection surface positioned beneath the drive platform and in communication with the collection tank, the two stage separation system having a large debris removal system and a fine debris removal system wherein the large debris removal system collects large debris from the collected water for removal from the collection tank, and the fine debris removal system collects small debris suspended in the collected water after the collected water moves from the large debris removal system to the fine debris removal system.

Advantages of the present invention are: the wash system extends vehicle life, eliminates track out in local townships, has structural stability, employs zero flocculants, may be portable and located at key points within a site operation, targets under body and tires employing high volume, high pressure nozzles, requires minimal cycle time (less than two minutes per cleaning), can be a self contained unit, has automatic accumulation and solids removal for safe disposal, and recycles the heated or unheated water for continuous use.

BRIEF DESCRIPTION OF THE DRAWINGS

A detailed description of the preferred embodiment is provided herein below by way of example only and with reference to the following drawings, in which.

Figure 1A:
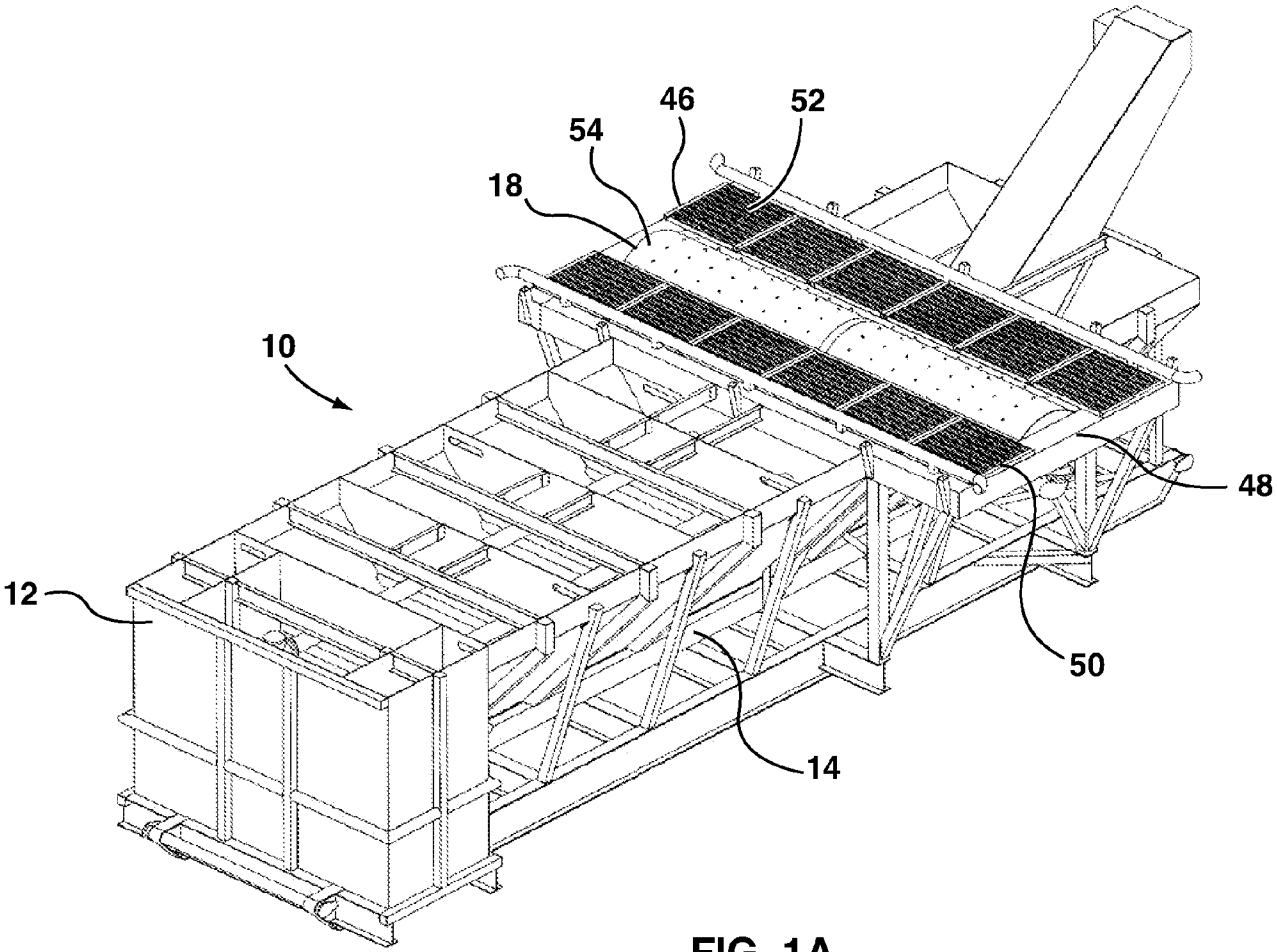
FIG. 1*a* in a perspective view, illustrates a portable or fixed vehicle washing system in accordance with the preferred embodiment of the present invention.
Figure 1B:
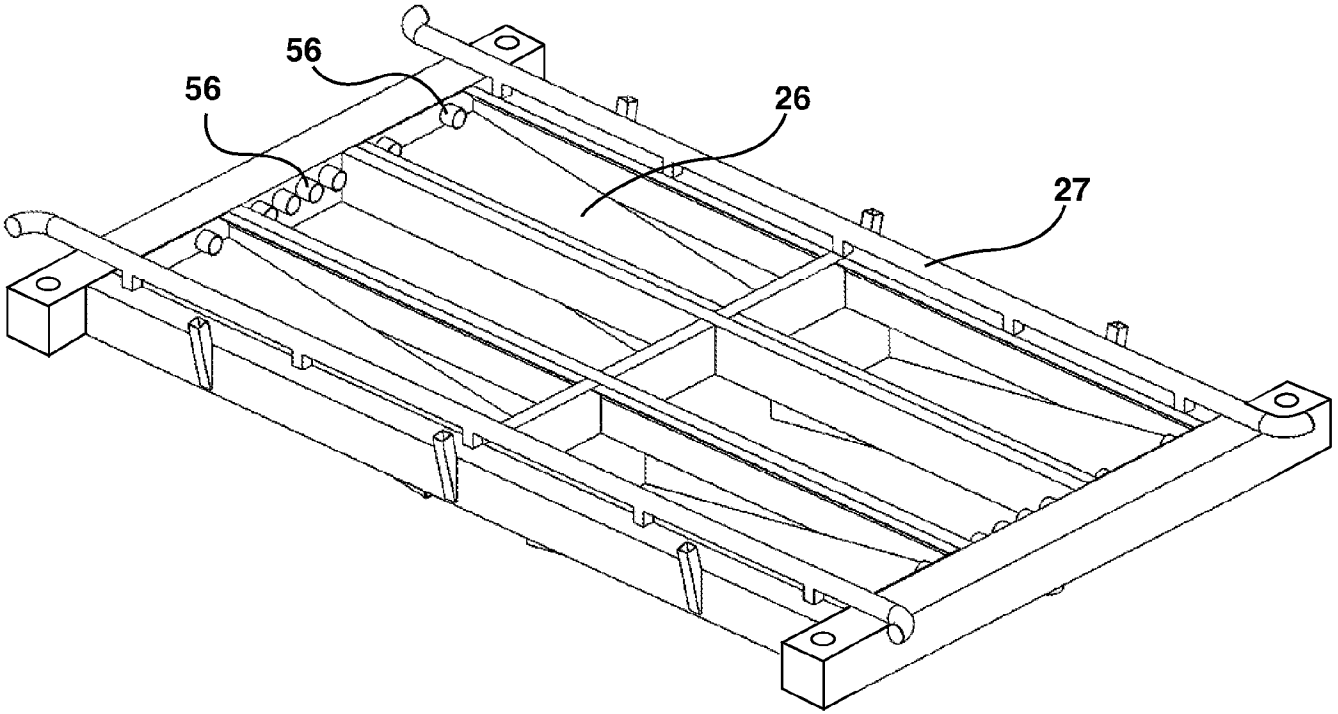
FIG. 1*b* in a top perspective view, illustrates the floor pan system, the bumper rails and connections engagement members.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 3A:
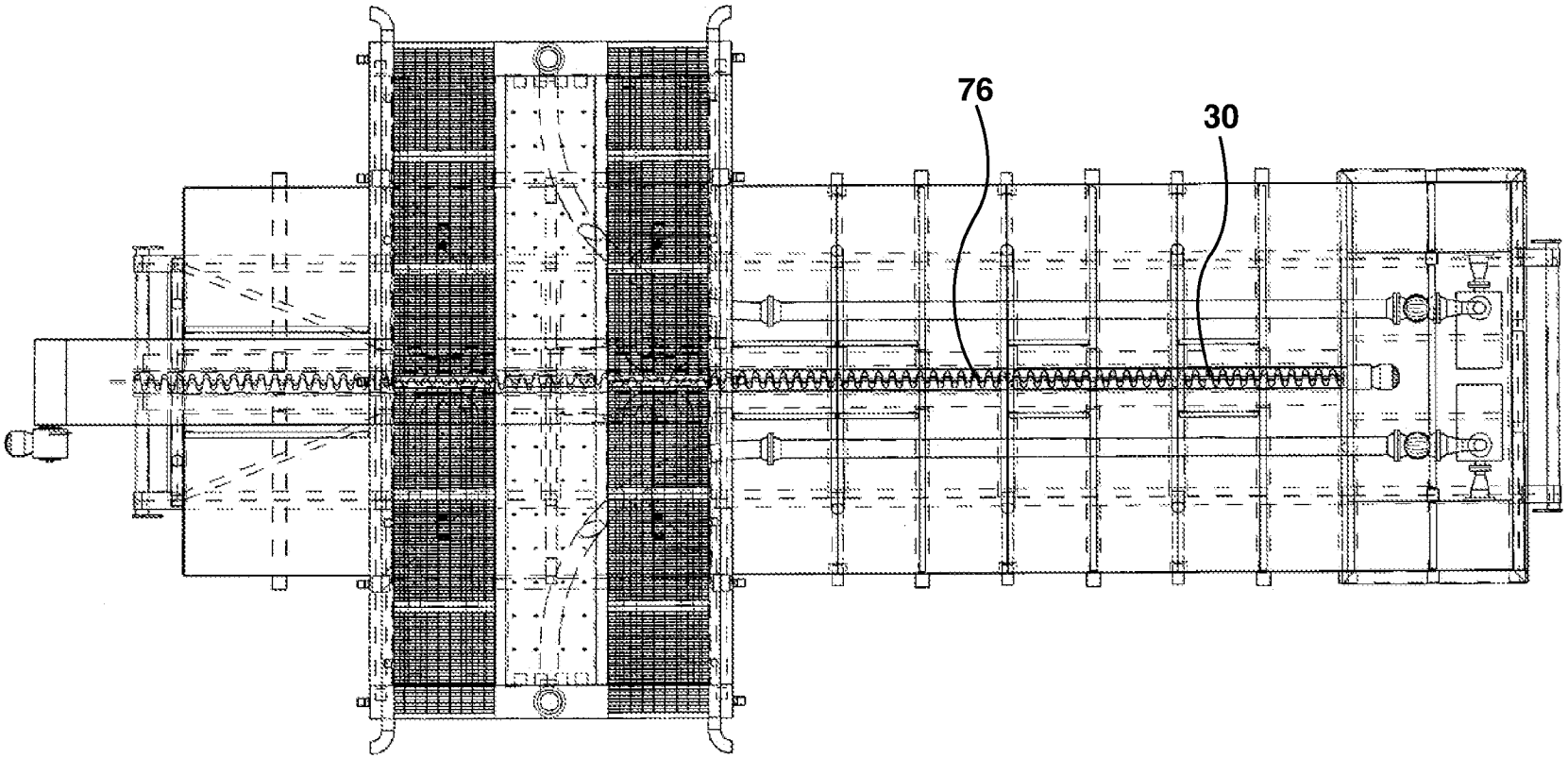
FIG. 3*a* in a top plan view, illustrates the portable or fixed vehicle washing system of FIG. 1.
Figure 3B:
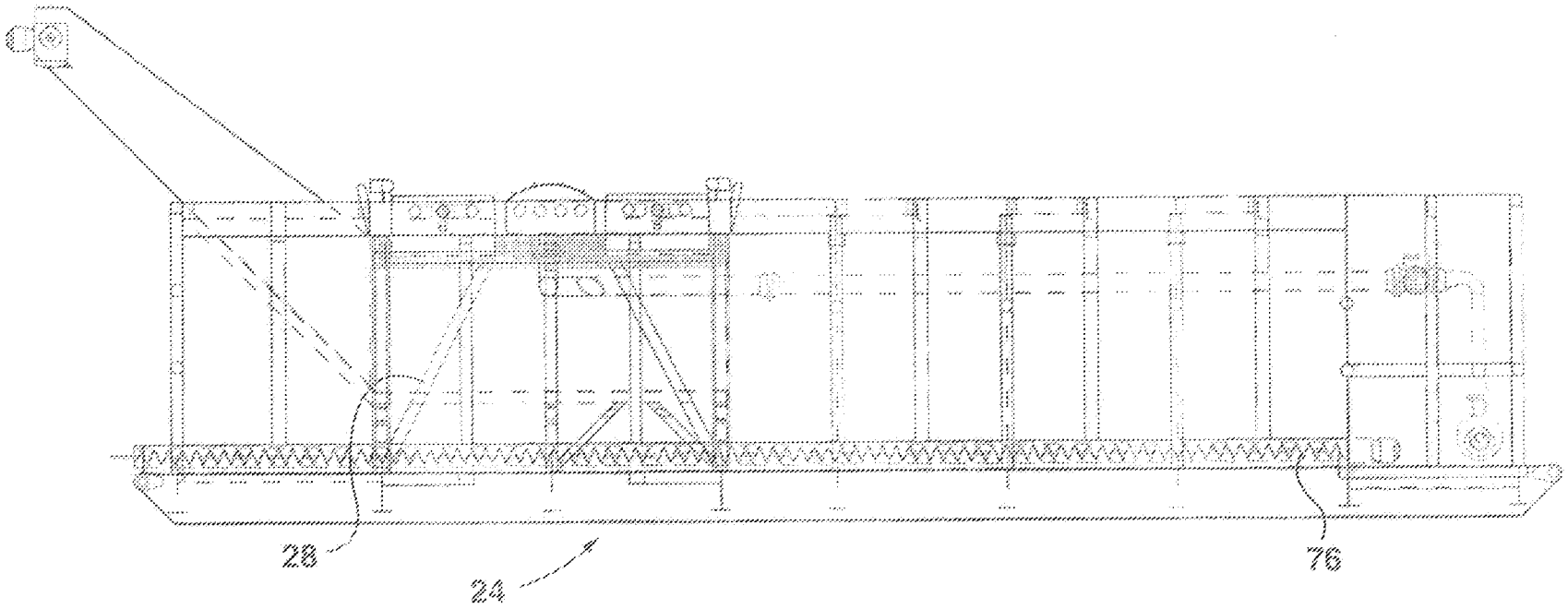
FIG. 3*b* in a side plan view, illustrates the portable or fixed vehicle washing system of FIG. 1.
Figure 3C:
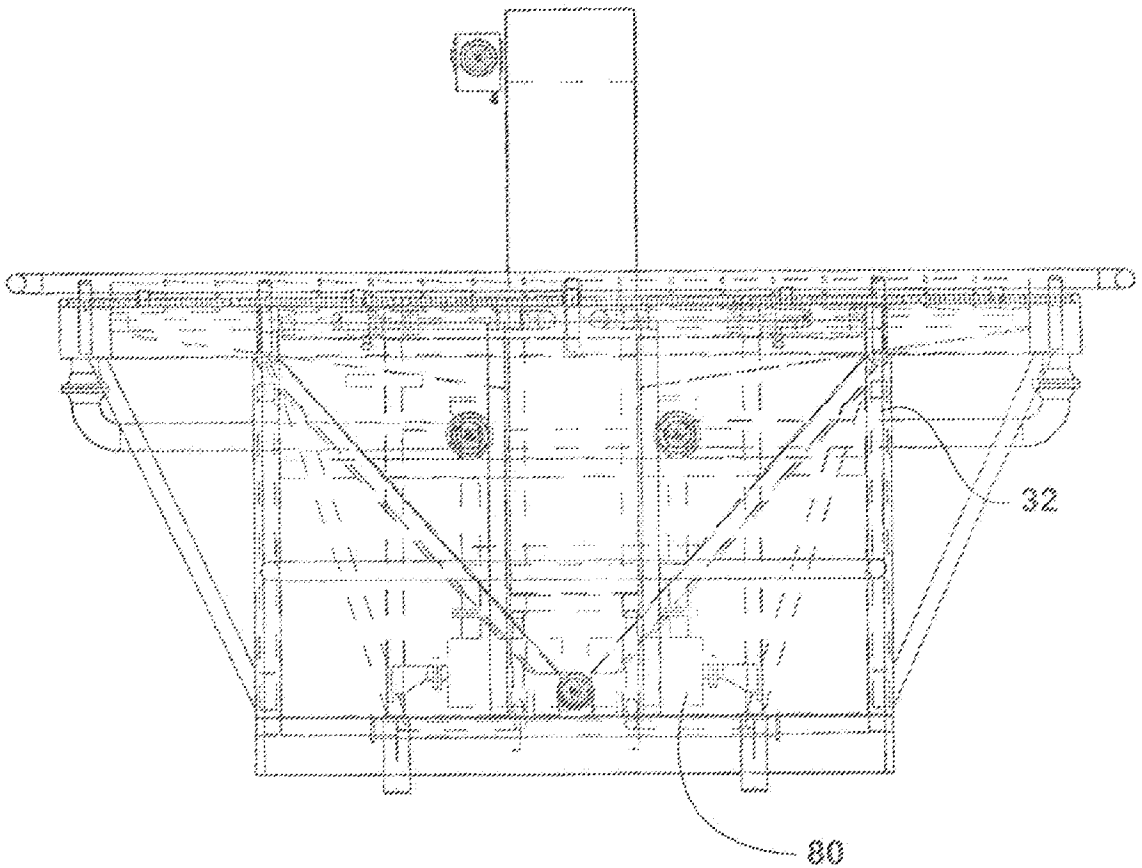
FIG. 3*c* in an end plan view, illustrates the portable or fixed vehicle washing system of FIG. 1.
Figure 4A:
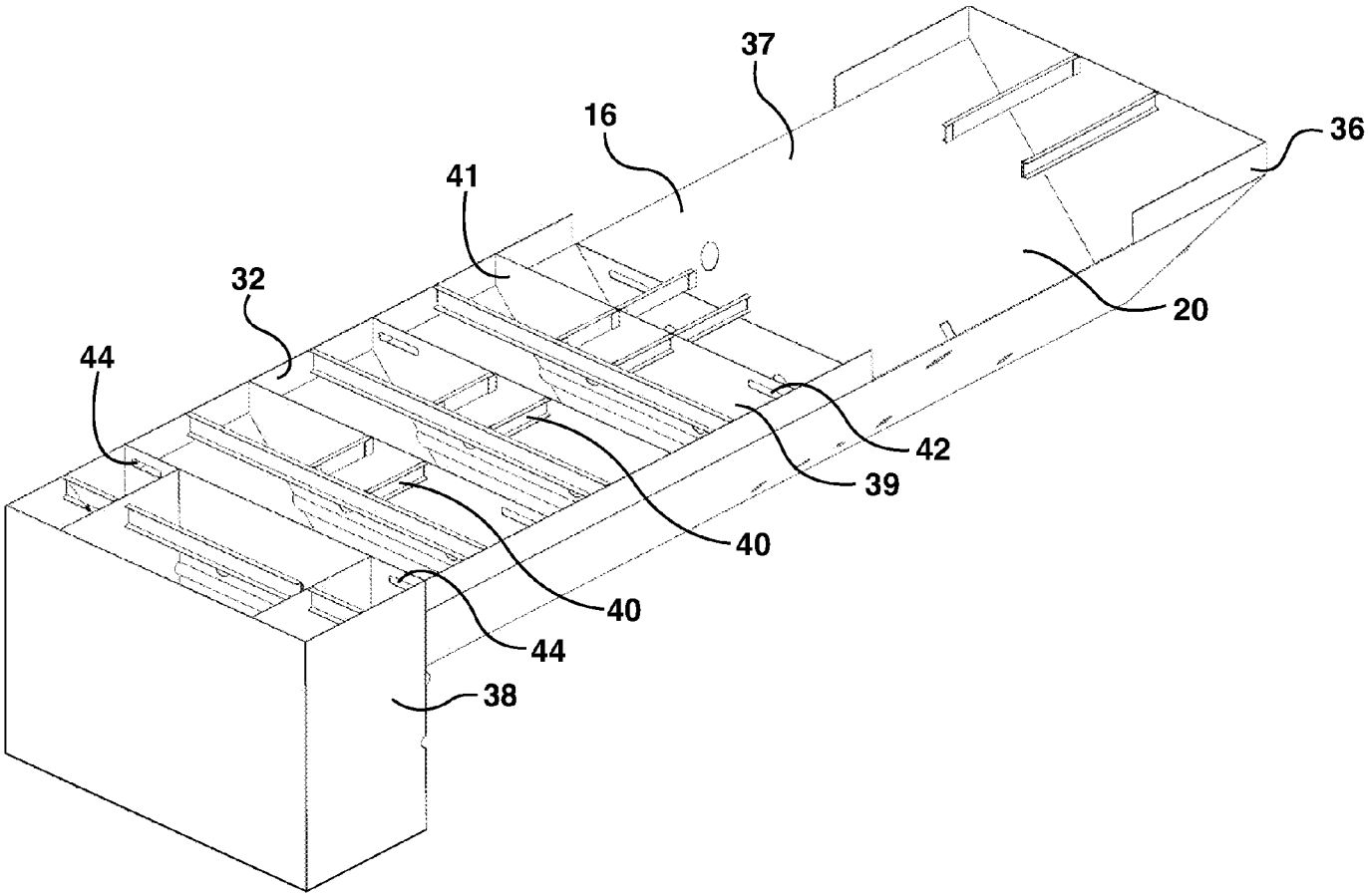
FIG. 4*a* in a perspective view, illustrates the collection tank of the portable or fixed vehicle washing system of FIG. 1.
Figure 4B:
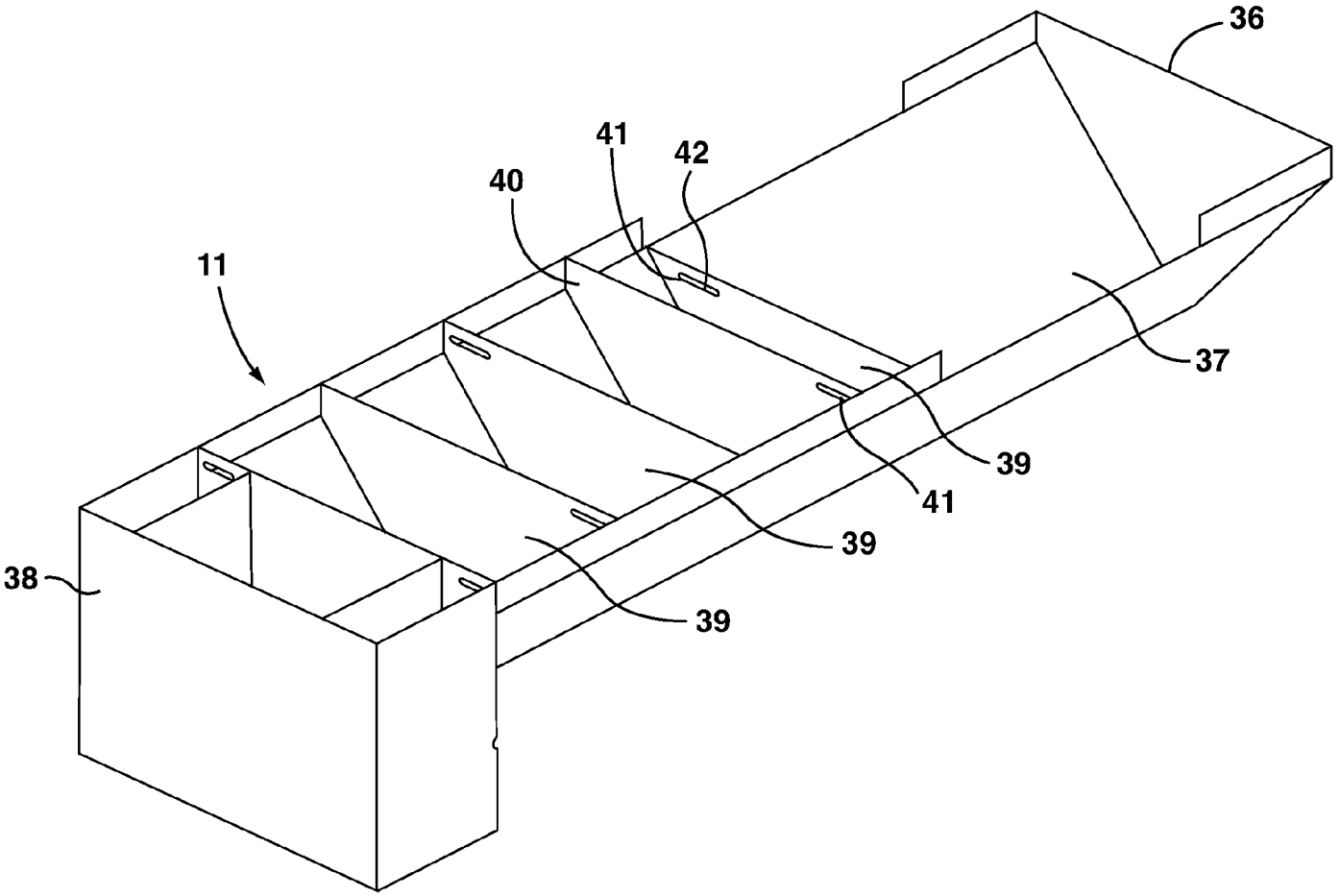
FIG. 4*b* in a perspective view, illustrates the collection tank of the portable or fixed vehicle washing system detailing the weir plate screen filter system of FIG. 1.
Figure 4C:
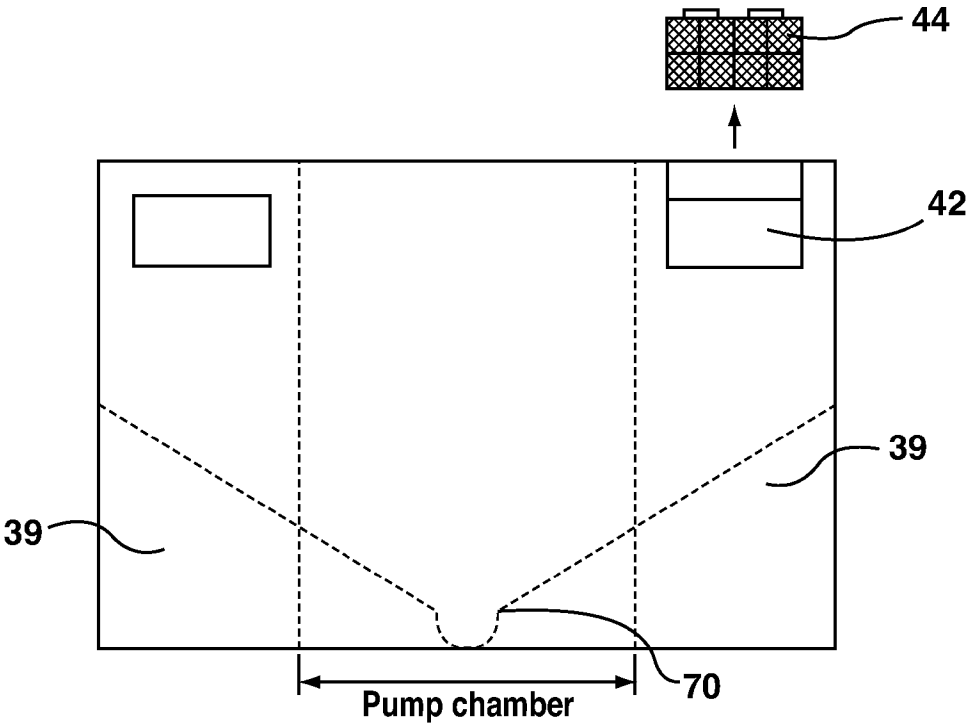
FIG. 4*c* in an end plan view, illustrates the portable or fixed vehicle washing system intake openings and removable intake screens of FIG. 1.
Figure 6A:
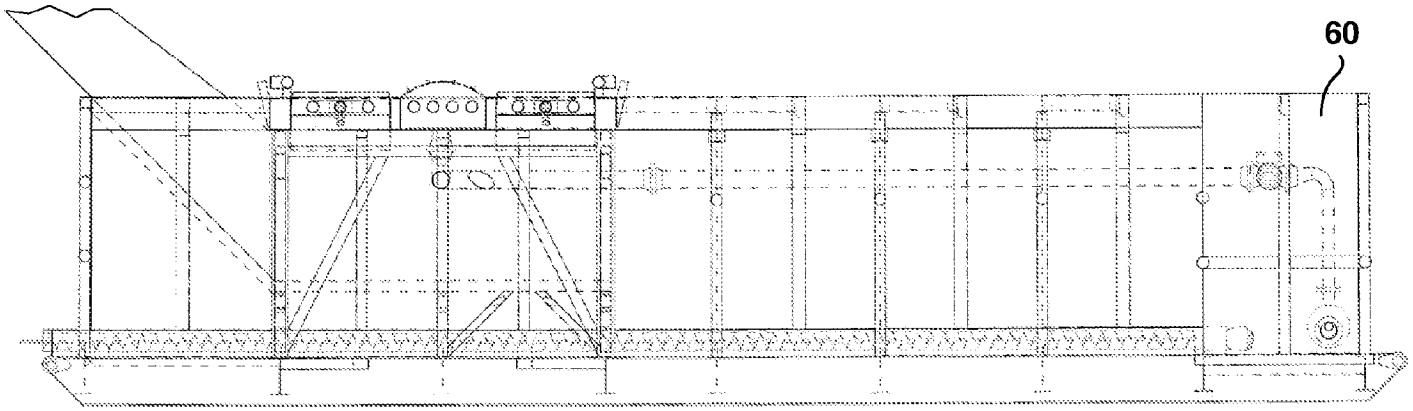
FIGS. 6*a* and 6*b* in elevation side views, illustrate the portable or fixed vehicle washing system of FIG. 1.
Figure 6B:
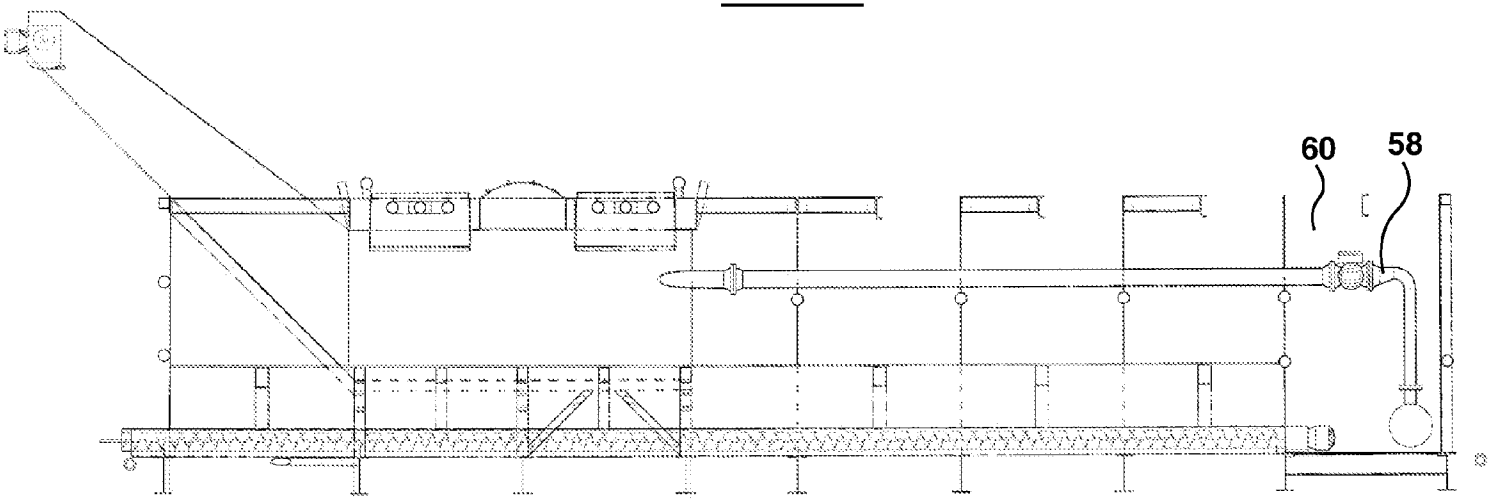
Figure 7A:
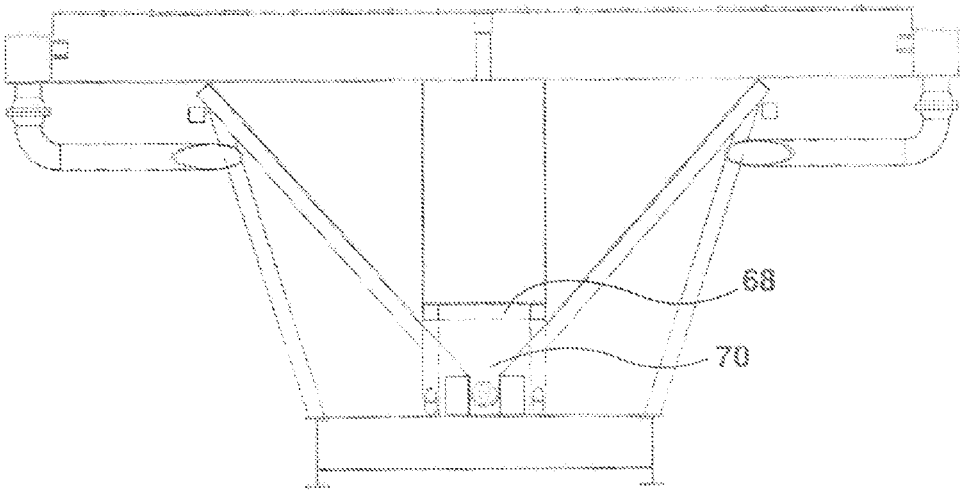
FIGS. 7*a* and 7*b* are sections views of the portable or fixed vehicle washing system of FIG. 1.
Figure 7B:
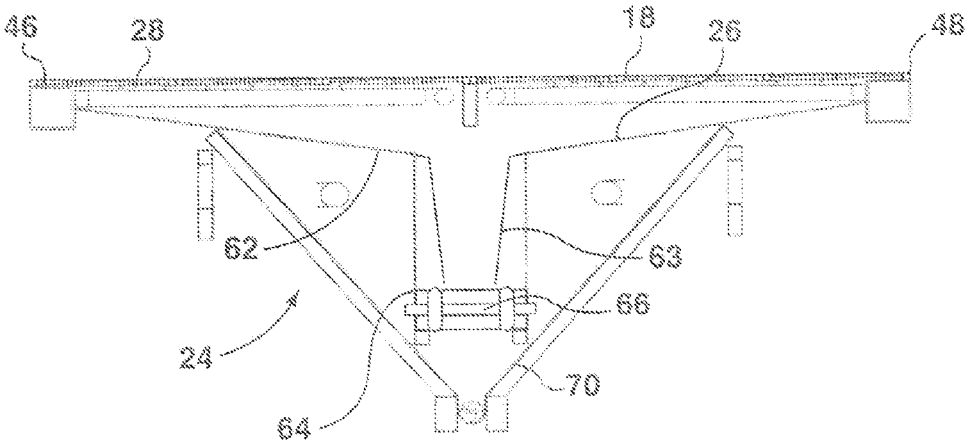

Referring to FIGS. 1 and 4, there is illustrated in a perspective view, A portable or fixed vehicle wash system 10 and method of operation in accordance with a preferred embodiment of the present invention. In overview the oil sands vehicle wash system 10 includes a collection tank 12 having a floor 14 and an opening 16. The wash system 10 further includes a vehicle drive platform 18 positioned above at least a portion 20 of the opening 16 of the collection tank 12. Referring to FIG. 6*a*, a water jet delivery system 22 is within the vehicle drive platform 18 for delivering a cleansing amount of water to the vehicle. Referring to FIGS. 8*a* to 8*g*, a two stage separation system 24 that has a collection surface 26 positioned beneath the vehicle drive platform 18, is in communication with the collection tank 12 for depositing the collected water. Referring to FIGS. 3*a* to 3*c*, the two stage separation system 24 has a large debris removal system 28 and a fine debris removal system 30. The large debris removal system 28 collects large debris from the collected water for removal from the collection tank 12, and the fine debris removal system 30 collects small debris suspended in the collected water, after the collected water moves from the large debris removal system 28 to the fine debris removal system 30.

Figure 2:
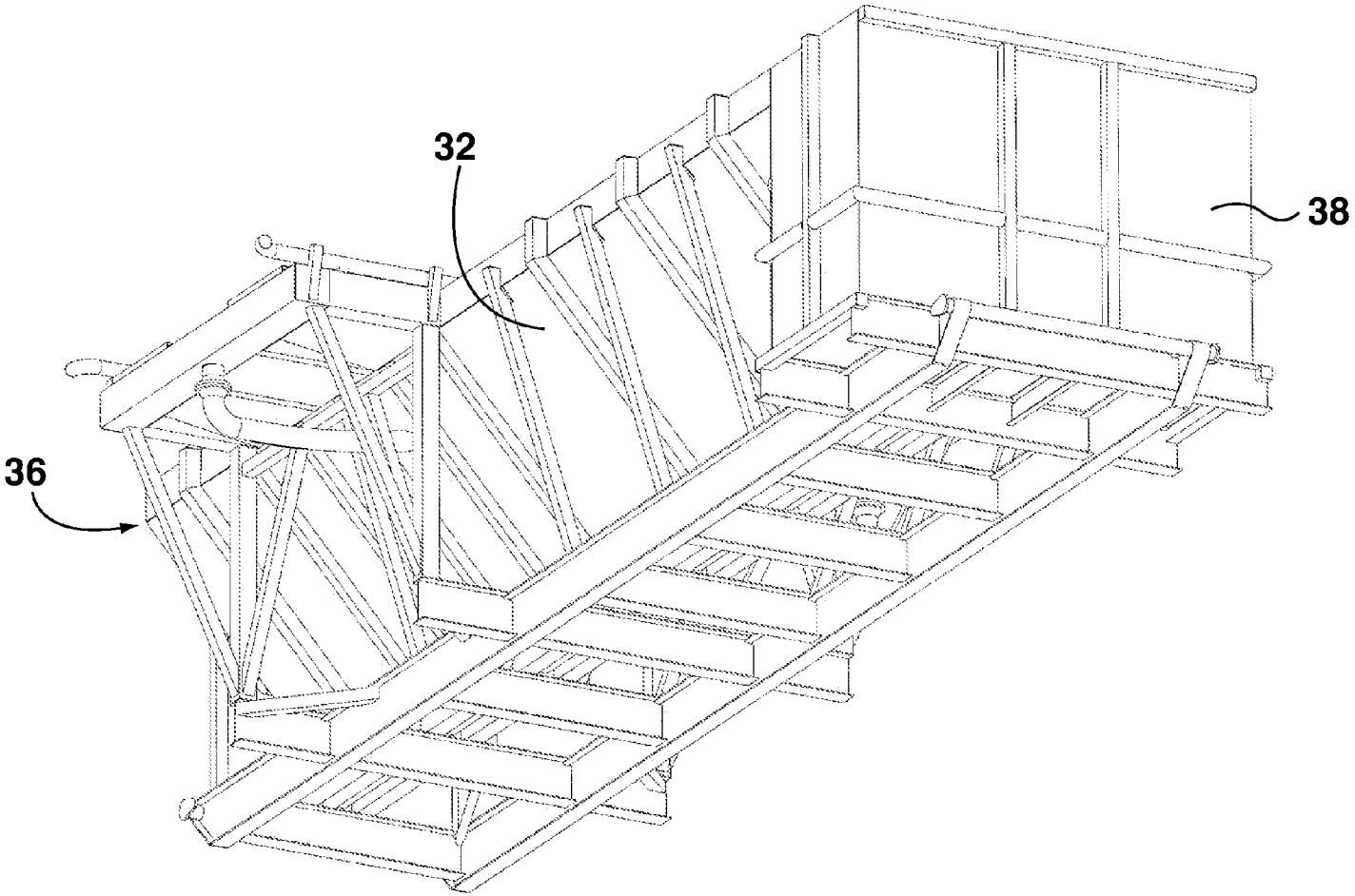
FIG. 2 in a bottom perspective view, illustrates the portable or fixed vehicle washing system of FIG. 1.
Figure 5A:
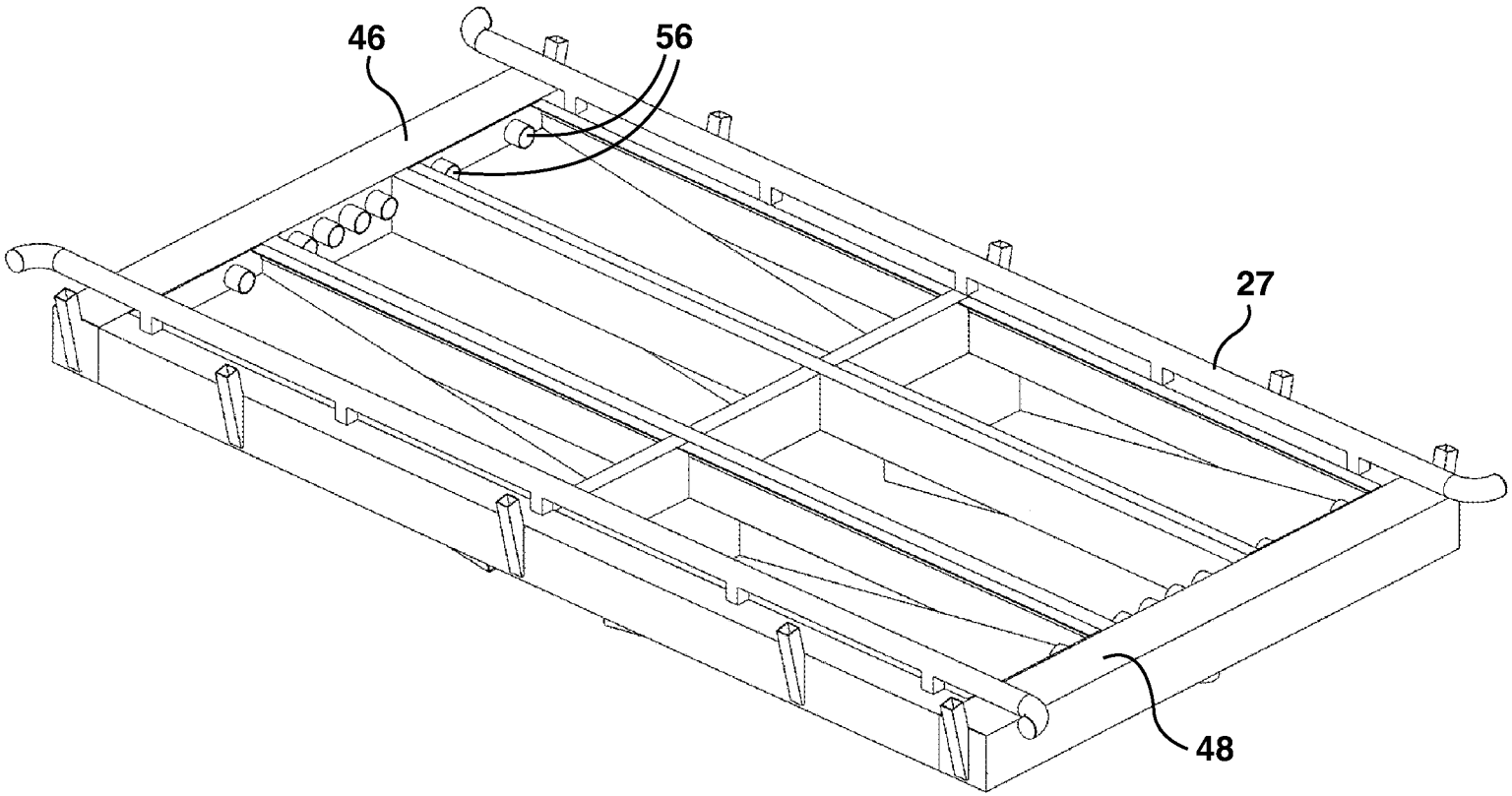
FIG. 5*a* in a perspective view, illustrates the vehicle drive platform of the portable or fixed vehicle washing system of FIG. 1.
Figure 5B:
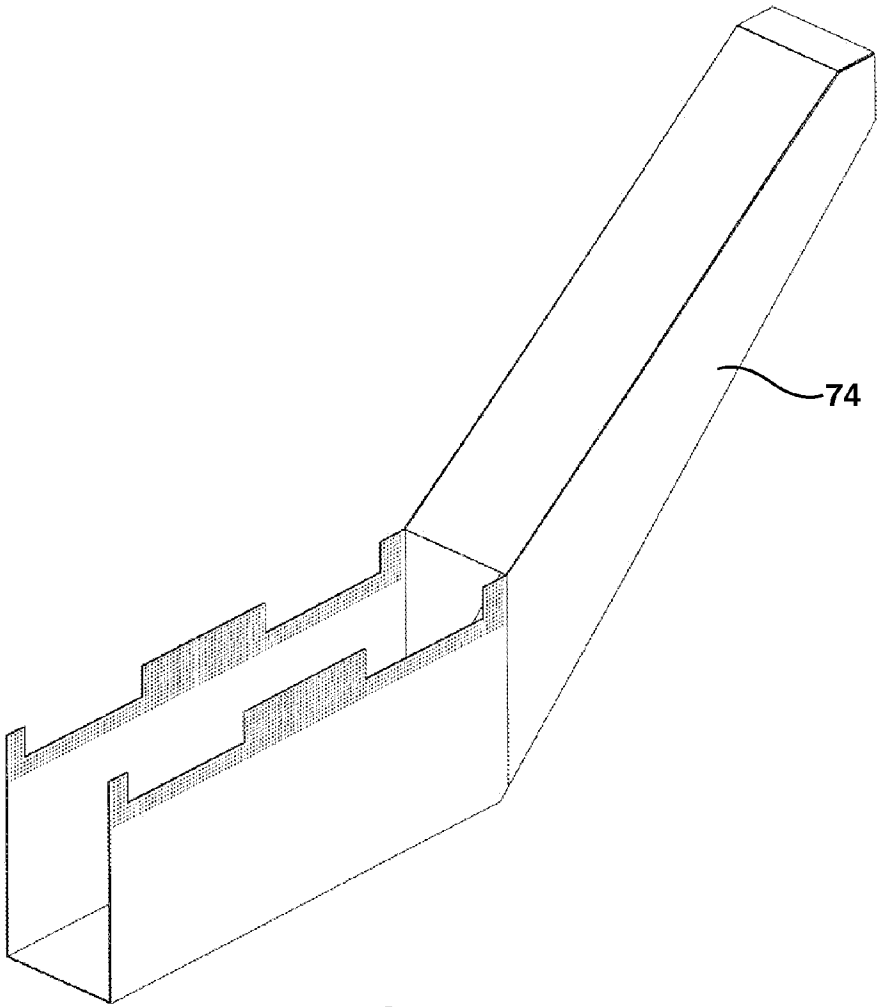
FIG. 5*b* in a perspective view, illustrates the chain drag weir system and the water jet delivery system of the portable or fixed vehicle washing system of FIG. 1.

Referring to FIGS. 2, 4 and 5, the collection tank 12 may be further defined as being a hopper shaped collection tank 32 supported by a rectangular shaped framework 34. The collection tank 12 may have a first end 36 and a second end 38. The first end 36 may be adapted to have the opening 16 over which the vehicle drive platform 18 is perpendicularly positioned to the collection tank 12. The first end 36 of the collection tank 12 also houses the large debris removal system 28. The second end 38 of the collection tank 12 may further include the fine debris removal system 30. The first end 36 of the collection tank 12 may be further defined as a first collection tank 37 that houses the large debris removal system 28.

The second end 38 of the collection tank may be divided into a series of intake chambers 39 that are separated from one another by a series of baffles 40. The series of baffles 40 are positioned down the length of the collection tank 12, namely starting at point after the first collection tank 37. The baffles 40 extend across the width of the collection tank 12 and include a series of weir members or plates 41 that include screened openings 42 that allows for the flow of the collected water to circulate through the intake chambers 39. The screened openings 42 have a screens 44 that vary in coarseness, the finest screen 44 being positioned at the final baffle 40 positioned at the second end 38 of the collection tank 12.

Referring to FIGS. 1*a* to *c*, 3*a* to *c*, 6*a*, and FIGS. 8*a* to 8*g*, the vehicle drive platform 18 is mounted to the first end 36 of the collection tank 12 over the opening 16, and more specifically over the first collection tank 37. The vehicle drive platform 18 is configured to engage the ground so as to allow the vehicles to drive across the drive platform 18. Specifically the vehicle drive platform 18 has an entrance side 46 and an exit side 48. The vehicle drive platform 18 may have two defined tracks or bar grading 50 that may be comprised of a series of slats 52, by way of example only so as to ensure that water and debris can fall from the undercarriage and tires of the vehicle and pass through the slats 52 to the first collection tank 37 below. The vehicle drive platform 18 may further include a series of bumper rails 27 that run the length of the vehicle drive platform 18 to guide the vehicles across the vehicle drive platform 28.

The water jet delivery system 22 is positioned beneath and in between the two defined tracks 50 of the vehicle drive platform 18. The water jet delivery system 22 can include a series of jet nozzles 54 positioned beneath and between the bar grading 50 and connected to a water pumping system 56 that is positioned under and between the bar grading 50. Typically there can be as many of 120 nozzles per pump delivering a focused stream line spray and spray up through the vehicle drive platform 18. The water pumping system 56 may be a variety of configurations. Typically the water pumping system 56 is required to pump 600 gallons per minute of water per pump via the series of jet nozzles 54. The water pumping system 56 also includes piping for delivering under pressure the filtered collected water from the second end 38 of the collection tank 12 to the first end 36 of the collection tank 12. More specifically the water is delivered to a charged header 47 at both the entrance side 46 and the exit side 48 of the vehicle drive platform 18. The pumping system 56 includes a series of pumps 58 located at the end of the second end 38 of the collection tank 12 in a final intake chamber 60.

The collection surface 26 of the two stage separation system 24 may be further defined as at least one floor pan 62 that is mounted at an angle beneath the vehicle drive platform 18 to the first collection tank 37. Specifically a floor pan 62 can extend away from the wall of the collection tank 12 in a downwards angle so as to slope towards the centre of the first collection tank 37. The angle that the floor pan 62 can vary in acuteness. The small the angle the less of the downwards slope allowing for smaller and lighter debris to have sufficient time to migrate and clump together. Typically the preferred angle of the downward slope is no greater than ¼ inch over 12 inches. Engagement members 64 such as riffles may be positioned on the floor pan 62 that engage the collected water and specifically the smaller and lighter debris. The engagement members 64 aid in the clumping together of the smaller debris to form larger debris and therefore be removed by the large debris removal system 28.

The angle of the floor pan 62 can be larger and therefore provide a more steep slope for the floor pan. Larger and heavier debris benefits from a steeper slope and a smooth surfaced floor pan 62 as it can easily separated out of the collected water and be removed by the large debris removal system 28. The angle of the downward slope of the floor pan 62 therefore impacts the rate of flow of the water through the washing system 10, and the type of debris being collected impacts the effectiveness of the washing system 10. An incorrect angle of the downward slope of the floor pan 62 results in the heavier material not being cleared away efficiently while allowing build-up in the floor pan 62. Deflection plates 63 extend down from the floor pan 62 or collection surface 26 into the first collection tank 37. The deflection plates 63 aid in the flow direction of the collected water and debris as it falls from the vehicle drive platform 18 down into the first collection tank 37 and onto the large debris removal system 28.

Referring to FIGS. 6*b*, 6*c*, 7*a* and 7*b*, the first large debris removal system 28 may be further defined a drag chain weir system 66 which engages and removes the large debris from the first collection tank 37. The drag chain weir system 66 may further include the drag chain conveyor 68 positioned beneath the vehicle drive platform 18 above the floor 70 above the hopper shaped collection tank 32 at the first end 36 of the first collection tank 37. The drag chain conveyor 68 having flights may be positioned in a drag chain chamber 74 that extends above the floor 70 and then out and above the opening 16 of the first end 36 of the first collection tank 37. The instant configuration allows for the large debris to fall onto the floor pan 62, down into the flat bottom shaped drag chain chamber 74 via the deflection plates 63 to land on the flights of the drag chain conveyor 68, which moves the large debris along the floor 74 of the drag chain collection tank system 66, then up and out of the collection tank 32 to be deposited above ground. The deflection plates 63 are critical in that their absence would not aid in the immediate removal of the large debris by the drag chain conveyor 68, as the large debris would instead be immediately sucked up by the fine debris removal system 30.

Referring to FIGS. 3*a* to *c* and 7*a* to *b*, the fine debris removal system 30 further includes an auger system 76 that is position along the floor 70 of the hopper shaped collection tank 32 from the end of the first collection tank 37, namely at the first intake chamber 39, down the length of the floor of the hopper shaped collection tank 32. The collected water having fine suspended debris flows off the floor pan 62 and down the deflection plates 63 and into the first collection tank 37. The fine debris and collected water can weir up under the deflection plates 63 in the first collection tank 37 and into the first intake chamber 39 via a screened opening 78. The fine debris that settles out of each intake chamber 39 as the collected water moves through hopper shaped collection tank 32, collects on the floor 70 and specifically the auger system 76.

More specifically once the collected water enters into the intake chambers 39 and flows in a serpentine pattern through the series of baffles 40 and screened openings 42 that subsequently filter the collected water through the progressively finer set of screens 44 down the collections tank 32 thereby aiding the filtering process and removal of fine debris. The final collection tank 60 is positioned to receive the cleaned collected water which is then reused and pumped back into the washing system 10.

The auger system 76 is then able to auger the fine debris and some of the collected water to a centrifuge system 80. The centrifuge system 80 can engage the fine debris and collected water and further condense the fine debris out of the collected water, depositing the fine debris for easy removal of the fine debris from the washing system 10. More specficially the auger system 76 conveys concentrated fine debris toward the first collection tank 37 discharging the fine debris at a point under to the chain drag weir system 66, where it is then pumped to the centrifuge system 80 or filtration, settling tank, settling pond as per requests or environmental application requirements. The reclaimed water is then delivered back into the system and the process repeats for the next vehicle.

The auger system 76 may also be in communication with a sand filtration system 82 which is also capable of further condensing the fine debris out of the collected water for removal from the washing system 10. The hopper shaped collection tank 32 can be a variety of sizes depending on the desired requirements, however the acuteness of the sloping sides of the tank 32 must be sufficient to facilitate the flow of the fine debris into the auger system 76 as they settle out of the collected water.

Efficient removal of the fine debris such as sand and the like allows for the cleaned collected water to be reused within the wash system 10 up to 97% of the time. Efficient reuse of the water results in an environmentally effective use of water and protects the environment from collected water run off seen in typical washing system. Furthermore the instant invention does not require any chemicals or detergents to effectively remove the large and small debris.

In another embodiment of the present invention there is provided a method of washing a portable or fixed vehicle including driving the vehicle across a vehicle drive platform positioned above at least a portion of a collection tank having a floor and an opening; delivering a cleansing amount of water to the vehicle from a water jet delivery system positioned directly under the drive platform; collecting and depositing the collected water in a two stage separation system having a collection surface positioned beneath the drive platform and in communication with the collection tank, the two stage separation system having a large debris removal system and a fine debris removal system wherein the large debris removal system collects large debris from the collected water for removal from the collection tank, and the fine debris removal system collects small debris suspended in the collected water after the collected water moves from the large debris removal system to the fine debris removal system.

More specifically in operation the washing of the vehicle is two-stage process. The first half of the vehicle drive platform 18 is powered by a first pump detailed in FIGS. 3*a*, 3*b*, 7*a* and 7*b*. The second part is powered by a second pump detailed in FIGS. 3*a*, 3*b*, 7*a* and 7*b*. The vehicle drives up to the entrance of the drive platform 18 which activates a metal detecting sensor (not shown) initiating the first pump which delivered a cleaning amount of water to the vehicle which runs for a pre-determined time span. When the first pump completes its cycle, the vehicle continues forward where the second pump commences to deliver a cleaning amount of water for a pre-determined time span. At that point, the washing cycle is complete.

Figure 1C:
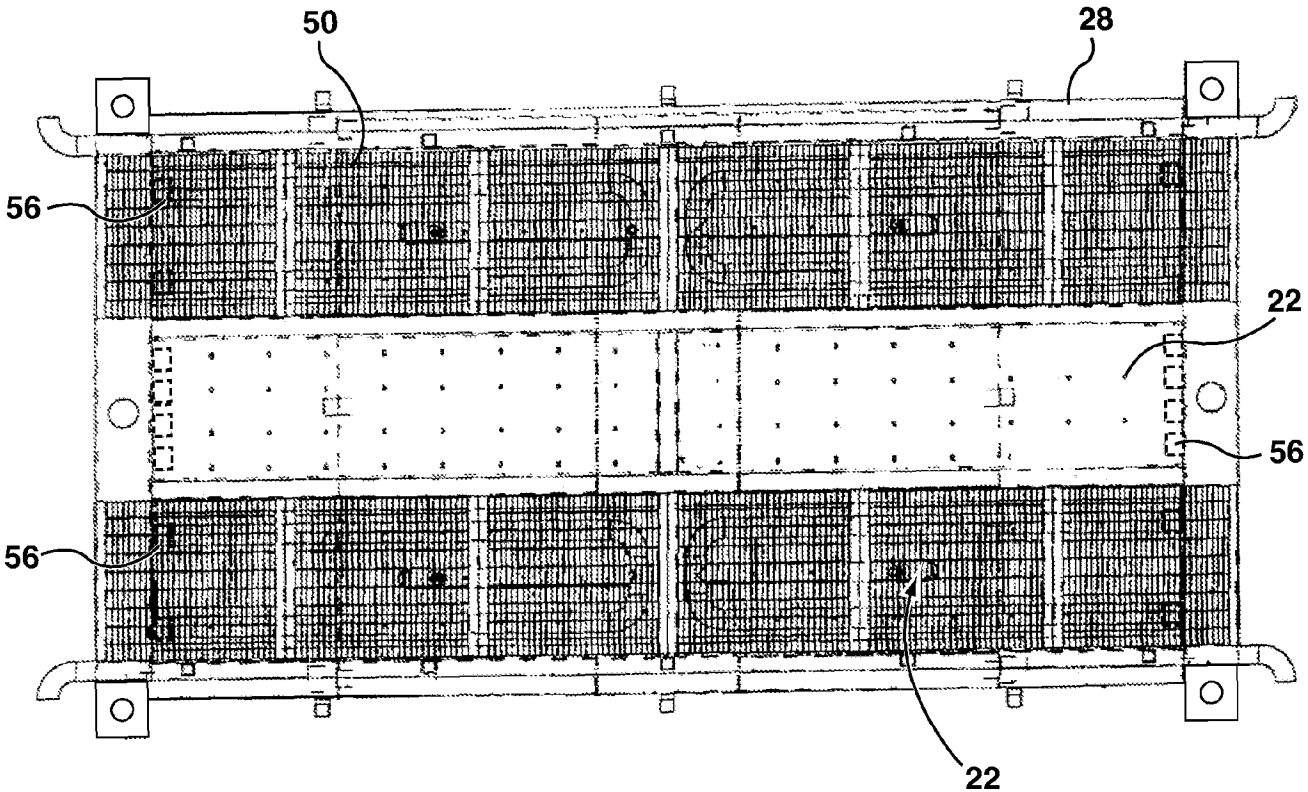
FIG. 1*c* in a top plan view, illustrates the drive platform, bar grading and wash pan systems.
Figure 1D:
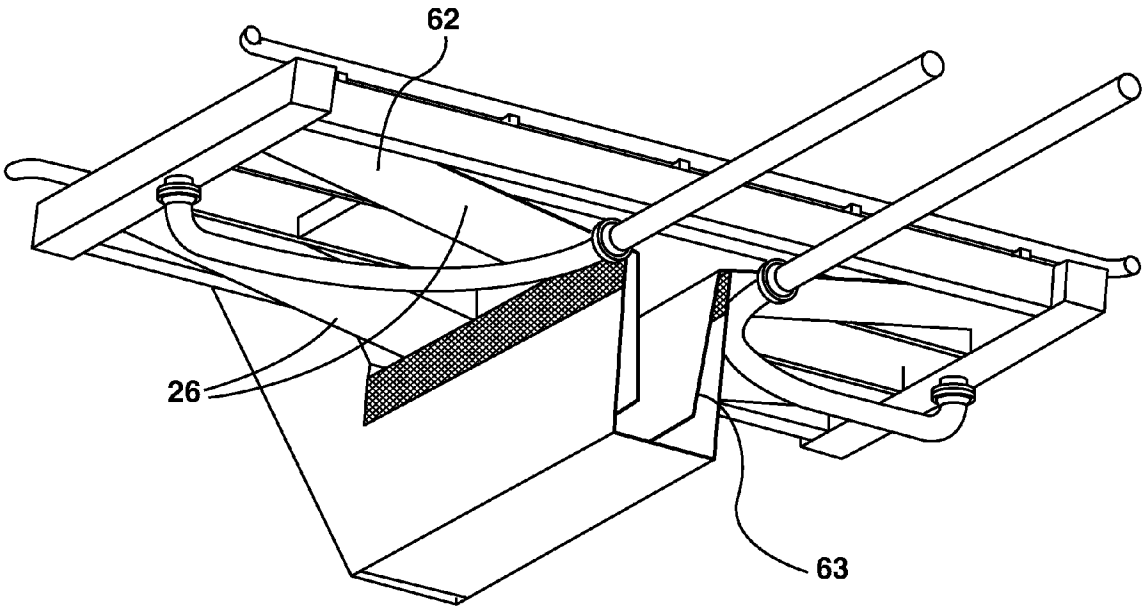
FIG. 1*d* in a bottom perspective view, illustrates the attachment of the chain drag separation system to the drive platform and the piping from pump to the water jet delivery system.

Separation of debris and water begins initially in the floor pan 62 detailed in FIGS. 1*a*, 1*c* and 6*a*. The angle of the floor pan 62 is crucial in determining the type of material and volume of solids trapped. The floor pan 62 acts similarly to a sluice box in gold and mineral mining. Where smaller and lighter the material is being separated, the angle of the floor pan 62 may be reduced. Furthermore the application of the engagement members 64 or riffles promote clumping so that the fine debris clump and drop into the chain drag system 66 in as large a clump as possible.

The larger and heavier material needs a steeper angle of floor pan 62 to facilitate separation. Therefore the three critical aspects, namely the angle of the floor pan 63, the speed of the flow of water and the type of material requiring separation, are dependent on the precision of the angle of the floor pan so that the combination of flow and type of materials induces separation. The fine materials clump and drops, while the heavier material keeps moving without lingering and building up in the floor pan. The water and debris are guided to the bottom of the drag chain weir system 66 namely the chain drag trough 67 detailed in FIG. 1*c* by the deflection plates 63 ensuring the large debris are captured and removed by the flights in the drag chain weir system 66. Fine particles not captured in the initial separation of the drag chain weir system 66 travel up under the deflection plates 63 through the first screening 78 built into the wall of the drag chain weir system 66. As the collected water flows back towards the intake chamber 39 it must travel through the series of weir plates 41 with screened openings 42.

The initial screening process begins at the chain drag weir system 66 detailed in FIG. 1*c* with one quarter inch (¼") screening holes, by way of example only. The screening gradually gets smaller as water passes through the weir plates 42 (FIG. 4*a*). The type of screening used depends on the type of substance required to be removed from the water. Paper or fibrous removable screens can be used for proper environmental disposal if required. Various types of steel screens are also a viable application. The final screening is at the intake chamber 39 detailed in FIG. 4*a*. The size of the intake opening is relative to the type of screening required to allow adequate water flow and remove undesired contaminants from water with the desired screening material FIG. 4*b*. Sloped wall of the collection tank 37 aids in the accumulation of solids at the bottom of the collection tank 37, while the baffled slow path ensuring adequate retention time for the solids to properly separate from the fluids.

The method of washing may occur in a minimum of 40 seconds as the vehicles move continuously across the vehicle drive platform thereby allowing quick and frequent cleanings of the vehicles. Quick cleanings results in a reduction of lost time and money, since vehicles typically take a long time to get washed when using conventional systems and therefore also allows for more frequent cleanings. Furthermore effective and efficient cleanings with the instant method means a reduction in track out of the debris onto municipal roads.

Other variations and modifications of the invention are possible. All such modifications or variations are believed to be within the sphere and scope of the invention as defined by the claims appended hereto.

I claim:

1. A portable or fixed vehicle wash system comprising:

(a) a collection tank having a first end and a second end positioned within a rectangular framework having a floor and an opening;

(b) a vehicle drive platform having a perforated flat surface positioned perpendicular to and above at least a portion of the opening of the first end of the collection tank;

(c) a water jet delivery system positioned within the drive platform for delivering a cleansing amount of water to the vehicle, the water passing directly through the entire perforated surface of the vehicle drive platform to pass directly through the drive platform into the first end of the collection tank; and (d) a two stage separation system having a collection pan positioned perpendicular to and beneath the drive platform having a downward slope no greater than ¼ inch over 12 inches, the two stage separation system positioned within the collection tank and extending perpendicularly beyond the vehicle drive platform for separating and depositing the collected water, the two stage separation system having a large debris removal system positioned within the first end of the collection tank that includes a drag chain weir system having a drag chain conveyor, and a fine debris removal system having an auger system perpendicularly positioned on the floor of the second end of collection tank, wherein the large debris removal system collects large debris from the collected water and the collection pan for immediate removal from the collection tank, and the fine debris removal system constantly collects small debris suspended in the collected water that has settled onto the auger system and moves the small debris back to the drag chain conveyor of the large debris removal system for immediate removal.

2. A portable or fixed vehicle wash system as claimed in claim 1 wherein the collection pan is at least one floor pan having a downward angled slope greater than ¼ inch over 12 inches.

3. A portable or fixed vehicle wash system as claimed in claim 2 wherein the floor pan further comprises a series of engagement members that engage the large and small debris.

4. A portable or fixed vehicle wash system as claimed in claim 3 wherein the collection tank further comprises a series of chambers separated from one another by a series of weir members and a series of baffles, each baffle having a screened opening to allow the collected water to flow there between.

5. A portable or fixed vehicle wash system as claimed in claim 4 wherein the second fine debris removal system further comprises a centrifuge removal system in communication with the auger system for accepting the collected water.

6. A portable or fixed vehicle wash system as claimed in claim 4 wherein the second fine debris removal system further comprises a sand filtration system in communication with the auger system for accepting the collected water.

7. A portable or fixed vehicle wash system as claimed in claim 4 wherein the collection tank further comprises a series of intake chambers and pumping system for moving the collected water within the collection tank.

8. A portable or fixed vehicle wash system as claimed claim 4 wherein the screened openings of the baffles are graded course to fine.

9. A portable or fixed vehicle wash system as claimed in claim 3 wherein the engagement members are riffles secured to the floor pan and engage the fine debris.

10. A portable or fixed vehicle wash system as claimed in claim 9 wherein the floor pan further comprises a series of deflection plates extending from the floor pan into towards the floor of the bins and collection tank pan.

11. A portable or fixed vehicle wash system as claimed claim 1 wherein the water jet delivery system positioned directly under the drive platform for delivering a cleansing amount of water to the vehicle is a spray nozzle pumping framework in communication with the collection tank and positioned directly under the drive platform.

12. A portable or fixed vehicle wash system as claimed in claim 11 wherein the spray nozzle pumping framework has a capacity to pump a minimum of 60 gallons of water per minute.

* * * * *